United States Patent [19]

Koike et al.

[11] Patent Number: 5,053,678

[45] Date of Patent: Oct. 1, 1991

[54] MICROWAVE ION SOURCE

[75] Inventors: Hidemi Koike, Katsuta; Noriyuki Sakudo, Ome; Katsumi Tokiguchi, Machida; Takayoshi Seki, Hitachi; Kensuke Amemiya, Katsuta, all of Japan

[73] Assignee: Hitachi, Ltd., Tokyo, Japan

[21] Appl. No.: 323,837

[22] Filed: Mar. 15, 1989

[30] Foreign Application Priority Data

Mar. 16, 1988 [JP] Japan ..... 63-60379

[51] Int. Cl.[5] ..... H01J 27/18

[52] U.S. Cl. ..... 315/111.81; 315/111.21; 315/111.31; 315/111.41; 313/231.31; 250/423 R; 204/298.38

[58] Field of Search ..... 315/111.81, 111.21, 315/111.41, 111.31, 111.61; 313/231.31, 230, 363.1; 250/423 R, 423 F; 204/298.26, 298.38

[56] References Cited

U.S. PATENT DOCUMENTS

| | | | |
|---|---|---|---|
| 3,137,801 | 6/1964 | Brooks et al. | 250/423 R X |
| 3,740,554 | 6/1973 | Morgan, Jr. | 250/423 R |
| 3,778,656 | 12/1973 | Fremiot et al. | 313/63 |
| 3,789,414 | 1/1974 | Bauer et al. | 343/761 |
| 4,316,090 | 2/1982 | Sakudo et al. | 250/423 R |
| 4,393,333 | 7/1983 | Sakudo et al. | 315/111.81 |
| 4,409,520 | 10/1983 | Koike et al. | 315/111.81 X |
| 4,543,465 | 9/1985 | Sakudo et al. | 315/111.41 X |
| 4,563,240 | 1/1986 | Shibata et al. | 204/298.38 X |
| 4,598,231 | 7/1986 | Matsuda et al. | 315/111.81 |
| 4,611,121 | 9/1986 | Miyamura et al. | 315/111.81 X |
| 4,629,930 | 12/1986 | Sakudo et al. | 313/230 X |
| 4,658,143 | 4/1987 | Tokiguchi et al. | 315/111.81 X |
| 4,713,585 | 12/1987 | Ohno et al. | 315/111.81 |
| 4,739,169 | 4/1988 | Kurosawa et al. | 315/111.81 X |
| 4,745,337 | 5/1988 | Pichot et al. | 315/111.41 |
| 4,788,473 | 11/1988 | Mori et al. | 315/111.81 X |
| 4,857,809 | 8/1989 | Torii et al. | 315/111.31 |
| 4,883,968 | 11/1989 | Hipple et al. | 250/423 R |
| 4,911,814 | 3/1990 | Matsuoka et al. | 315/111.81 X |

FOREIGN PATENT DOCUMENTS

| | | |
|---|---|---|
| 59-96632 | 6/1984 | Japan . |
| 243955 | 3/1985 | Japan . |

OTHER PUBLICATIONS

The Review of Scientific Instruments, vol. 19, No. 12, Dec. 1945, pp. 905–910; R. N. Hall: "High Frequency Proton Source".

N. Sakudo, "Microwave Ion Source for Ion Implantation", Nuclear Instruments and Methods in Physics Research, B21 (1987), pp. 168–177.

Ishikawa et al., "Axial Magnetic Field Extraction-Type Microwave Ion Source with a Permanent Magnet", Rev. Sci. Instrum. 55(4), Apr. 1984 pp. 449–456.

*Primary Examiner*—Eugene R. LaRoche

*Assistant Examiner*—Do Hyun Yoo

*Attorney, Agent, or Firm*—Antonelli, Terry, Stout & Kraus

[57] ABSTRACT

A microwave ion source suitable for an apparatus which requires ions of an element of high reactivity such as oxygen, fluorine, etc., the microwave ion source being arranged to transmit microwaves between outer and inner conductors of a coaxial line. An ion extraction electrode is formed at least partly of a low magnetic permeability material while an acceleration electrode is formed of a high magnetic permeability material. The acceleration electrode is formed so as to have a structure in which a low magnetic permeability material of a certain thickness is stacked on the high magnetic permeability material at a plasma chamber side and openings of ion exit holes are formed in the portion of the low magnetic permeability material. A permanent magnet constituting a magnetic field generating means is provided to surround the microwave lead-in coaxial line. The direction of magnetization of the permanent magnet is made to coincide with the axial direction of the coaxial line. The end surface of the permanent magnet at the microwave lead-in side is coupled with the periphery of the high magnetic permeability material of the acceleration electrode through another high magnetic permeability material to form a magnetic path. The plasma chamber is formed of a dielectric insulator which transmits microwaves well. It is possible to realize an ion source in which ions can be extracted with a high electric field, and in which a high current ion beam can be extracted for a long time.

6 Claims, 6 Drawing Sheets

MICROWAVE ION SOURCE

BACKGROUND OF THE INVENTION

The present invention relates to an ion working machine for performing ion implantation, ion beam sputtering, surface reforming with ions, and so on, and particularly relates to a microwave ion source suitable for use in an apparatus which requires ions of an element of high reactivity such as oxygen, fluorine, etc.

Conventionally, there have been three kinds of methods for transmitting microwave energy as follows:

(1) Transmission through a rectangular waveguide;

(2) Transmission through a hollow cylindrical waveguide; and (3) Transmission through between outer and inner conductors of a coaxial waveguide.

The above method (3) using a coaxial waveguide has been widely used because of its various advantages as follows:

(a) The microwave energy can be guided even if a microwave ion source is made small in size;

(b) The microwave ion source can be made small in size with the impedance unchanged; and (c) Such a coaxial cable as generally sold can be used as the coaxial waveguide.

In such a conventional microwave ion source having a coaxial structure, as disclosed in JP-A-59-96632, a permanent magnet for generating a magnetic field is arranged to surround a plasma chamber (discharge chamber) and an ion extracting electrode supplied with a voltage different from that applied to the plasma chamber is formed of a high magnetic permeability material. Further, a coaxial line made of metal of high electrical conductivity for supplying the plasma chamber with microwave energy is exposed in the plasma chamber.

Accordingly, the above prior art has problems in the three points as follows.

(1) Since there exists an intense magnetic field of an order of 0.1 T in the space exerted with an electric field between an acceleration electrode and a deceleration electrode (ion extraction electrode), it is impossible to make the discharge-resistant voltage across the acceleration and deceleration electrodes high and therefore this technique is not suitable for large-current extraction.

(2) Since a permanent magnet is arranged to surround a plasma chamber, it is difficult to two-dimensionally enlarge the plasma chamber in its section.

(3) Since a microwave coaxial line is exposed in a plasma chamber, metal elements such as copper, titanium, etc., sputtered from the coaxial line mix with plasma generated in the plasma chamber to thereby lower the purity of the plasma. Further, the metal elements may attach onto the surface of a dielectric insulator interposed between the inner and outer conductors of the coaxial line to thereby make it impossible to supply the plasma chamber with a microwave.

SUMMARY OF THE INVENTION

It is therefore an object of the present invention to realize a microwave ion source in which ion extraction with a high electric field can be performed and a large current ion beam can be extracted for a long time.

It is another object of the present invention to realize a large area plasma chamber having a desirable extension in the horizontal direction.

It is a further object of the present invention to realize a microwave ion source in which a microwave coaxial line is wholly covered at its portion disposed within a plasma chamber with a dielectric insulator to thereby prevent metal elements from mixing into plasma from this portion of the microwave coaxial line so that the microwave ion source can operate for a long time.

The above objects can be achieved by the means (1) to (3) as follows.

(1) An ion extraction electrode is formed of a low magnetic permeability material while an acceleration electrode is formed of a high magnetic permeability material. However, the acceleration electrode is not wholly formed of a high magnetic permeability material but it is formed so as to have a structure in which a low magnetic permeability material of a certain thickness is stacked on the high magnetic permeability material at a plasma chamber side and openings of ion outgoing holes are formed in the portion of the low magnetic permeability material.

(2) A permanent magnet is provided to surround a microwave lead-in coaxial line. The direction of magnetization of the permanent magnet is made to coincide with the axial direction of the coaxial line. The end surface of the permanent magnet at the microwave lead-in side is coupled with the periphery of the high magnetic permeability material of the acceleration electrode through another high magnetic permeability material to form a magnetic circuit.

(3) The plasma chamber is formed of a dielectric insulator which transmits microwaves well.

Those means (1) through (3) have functions (a) to (c) as follows.

(a) The acceleration electrode formed of a high magnetic permeability material absorb the great part of a magnetic field of an order of 0.1 T generated in the plasma chamber to thereby reduce leakage of the magnetic field into a space exerted with an ion extraction electric field. Accordingly, the influence of the leaking magnetic field on charged particles in the space of ion extraction can be reduced and the discharge-resistant voltage at this place can be made high. Further, by the provision of the ion exit openings in a portion nearer to the plasma than the high magnetic permeability material, ions in the plasma trapped within the magnetic field can be led to the ion exit holes so that ions of high density can be extracted with no problem.

(b) By the provision of the permanent magnet at the coaxial line portion, it becomes unnecessary to arrange structural parts at the periphery of the plasma chamber, so that a large area plasma chamber can be realized. Further, in the case where only one coaxial line is arranged or a plurality of coaxial lines are arranged linearly, by coupling the permanent magnet with the acceleration electrode through a high magnetic permeability material to form a magnetic path, the efficiency of use of the magnetic field can be improved.

(c) By forming the plasma chamber of a dielectric insulator, the coaxial line member is not exposed to plasma, so that the contamination of plasma with metal elements can be prevented and continuous operation for a long time can be performed.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Prior to the description of the embodiments of the present invention, the principle of operation of the microwave ion source according to the present invention will be described hereunder.

Figure 1:
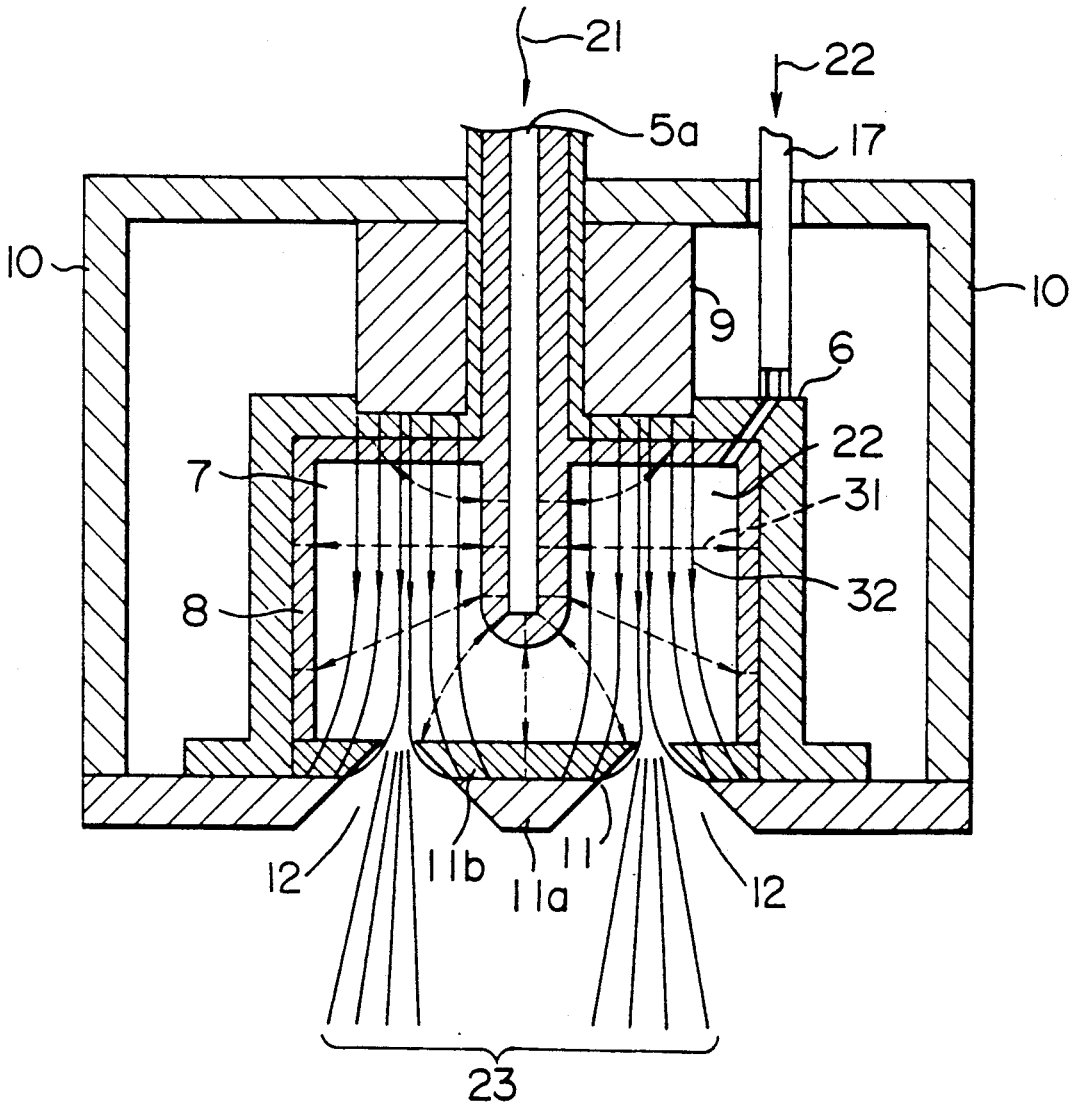
FIG. 1 is a section showing the relationship between the electric field and magnetic field generated in the plasma chamber of the microwave ion source according to the present invention.

FIG. 1 is a section for explaining the relationship between the electric field and magnetic field generated in the plasma chamber of the microwave ion source according to the present invention.

In FIG. 1, an electric field 31 due to a microwave 21 is an alternating field and generated between an inner conductor 5*a* of a coaxial line projected into a plasma chamber 7 and a coaxial discharge box 6. On the other hand, magnetic force lines 32 due to a magnetic field generating means 9 constituted by a permanent magnet are generated between the magnetic field generating means 9 and a high magnetic permeability material 11*a* of an acceleration electrode 11. Since the acceleration electrode 11 is provided with a low magnetic permeability material 11*b* at the plasma chamber 7 side, the magnetic force lines 32 can pass through ion exit holes 12 formed in the low magnetic permeability material 11*b*. In this condition, if there exist electrons in the plasma chamber 7, the electrons are subject to acceleration and deceleration by the microwave electric field while turning so as to twist about the magnetic force lines 32.

Such electrons collide with molecules of a sample gas 22 led into the plasma chamber 7 to thereby generate plasma. Although ions in the thus generated plasma are subject to interaction between the microwave electric field and the magnetic field generated by the magnetic field generating means 9, the ions cannot follow the change of the alternating electric field of the microwave and moves along the magnetic force lines 32 so as to twist about the magnetic force lines 32. Then, the ions reaching the ion exit holes 12 are extracted as an ion beam 23. The reference numerals 8 and 10 designate a dielectric insulator and a magnetic path respectively.

As described above, the magnetic field generating means 9 provided above the plasma chamber 7 and the acceleration electrode 11 having a lamination structure of the low magnetic permeability material 11*b* and the high magnetic permeability material 11a constitute a configuration which operates as a microwave ion source.

Next, referring to FIG. 2, a first embodiment of the present invention will be described hereunder.

The ion source according to the present invention is constituted by a microwave generator 1, a coaxial line or coaxial waveguide 2, another coaxial line constituted by an inner conductor (microwave leadin portion) 5, a coaxial discharge box 6, a plasma chamber 7, a dielectric insulator 8, a magnetic field generating means constituted by a permanent magnet 9, a magnetic path of a high magnetic permeability material 10, an acceleration electrode 11, a deceleration electrode or ion extraction electrode 13, an earth electrode 14, insulators 15 and 16, and a sample gas lead-in pipe 17.

The first embodiment has features as follows.

(1) The deceleration electrode 13 is formed of a low magnetic permeability material and the acceleration electrode 11 has a lamination structure of a high magnetic permeability material and a low magnetic permeability material.

(2) The permanent magnet 9 arranged so as to surround the coaxial line 5 is cylindrical and magnetized in the axial direction. The permanent magnet 9 has no limit in polarity and either end of thereof may be made to be the N pole. The microwave lead-in side end surface of the permanent magnet 9 is coupled with the high magnetic permeability material of the acceleration electrode 11 through a high magnetic permeability material so as to form the magnetic path 10, so that loss of the magnetic field can be prevented. Thus, the permanent magnet 9 may be reduced in size.

(3) The plasma chamber 7 is formed of the dielectric insulator 8.

The intensity of the magnetic field in the plasma chamber 7 is controlled so as to be about 0.05 to 0.1 T. In this ion source, a microwave 21 and a sample gas 22 such as $BF_3$, Ar, $O_2$, $N_2$, or the like, are led into the plasma chamber 7 so as to generate plasma and positive and negative voltages are applied to the acceleration electrode 11 and the deceleration electrode 13 respectively, so that the ion beam 23 can be extracted from the plasma.

Figure 2:
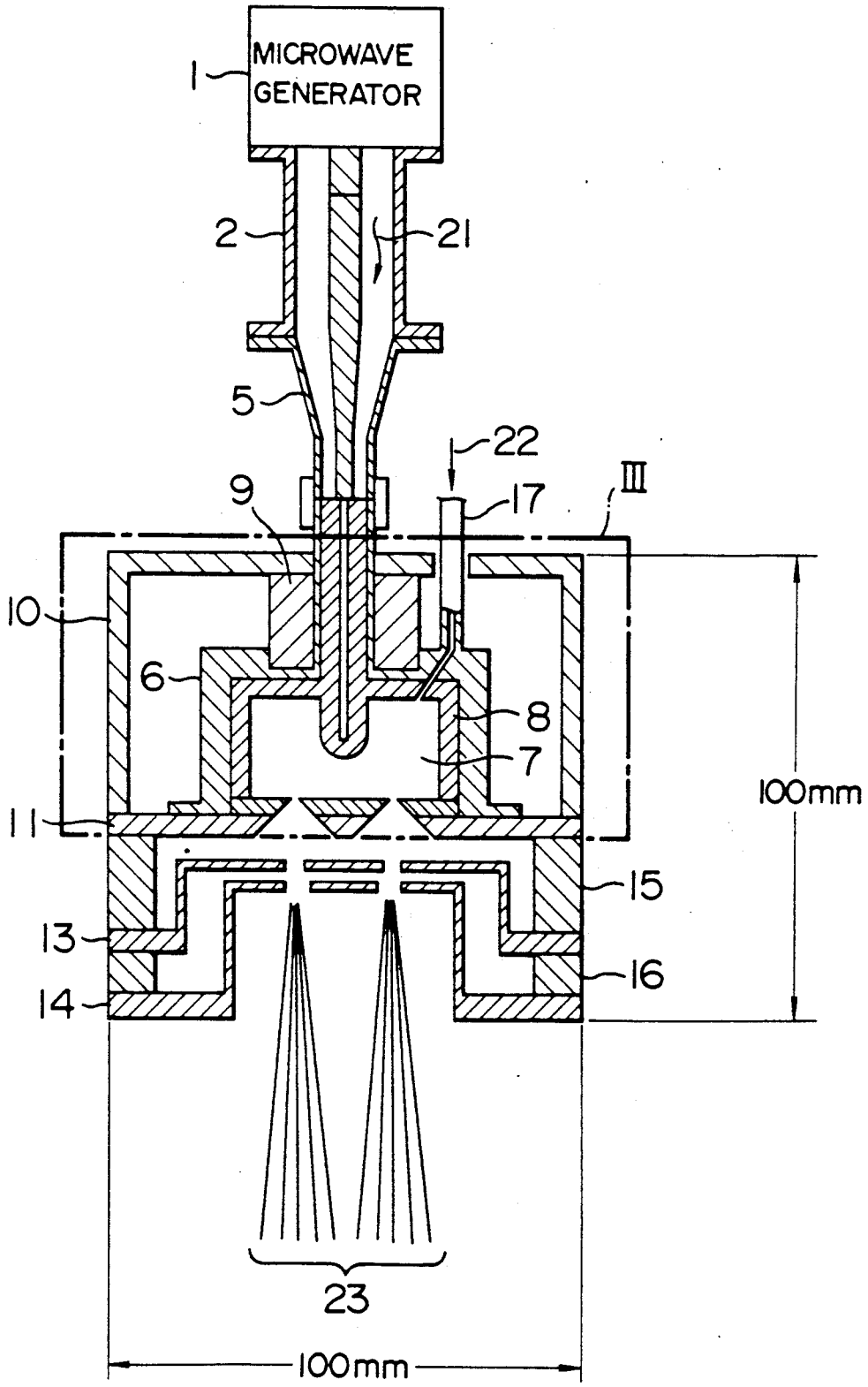
FIG. 2 is a section illustrating a first embodiment of the microwave ion source according to the present invention.
Figure 3:
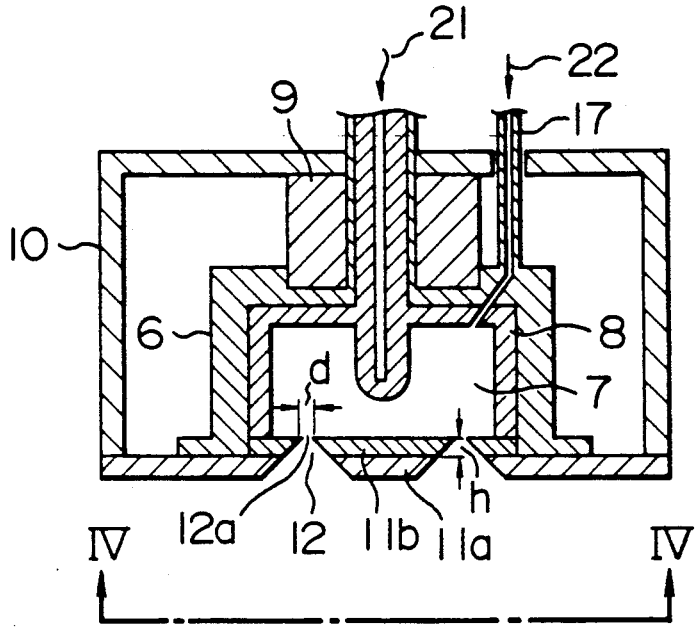
FIG. 3 is a detailed section showing the portion of III of FIG. 2.
Figure 4:
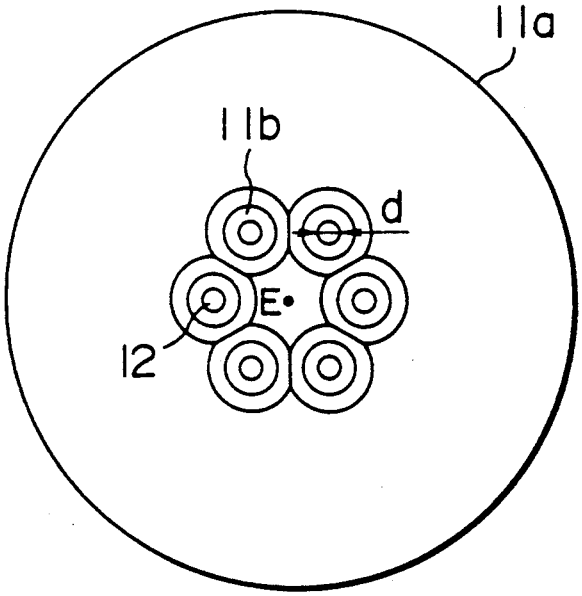
FIG. 4 is a plan viewed in the direction IV—IV in FIG. 3.

FIG. 3 is a detailed sectional view showing the portion of III around the plasma chamber 7 in FIG. 2, and FIG. 4 is a plan viewed in the direction IV—IV in FIG. 3.

In FIGS. 3 and 4, ion exit holes 12 are composed of six openings 12a formed on the same circumference so that those six holes are separated from each other. Each of the ion exit holes 12 has a substantially conical shape which is gradually widened from the plasma chamber 7 to the outside in the direction of ion extraction. The acceleration electrode 11 has a structure of lamination of the high magnetic permeability material 11*a* and the low magnetic permeability material 11*b*. The thickness h of the low magnetic permeability material 11*b* is selected to be substantially equal to the diameter d of each of the ion outgoing holes 12 at the plasma chamber 7 side, that is, $h \approx d$ (equal to about 3 mm). In this first embodiment, it is possible to realize the ion source in which a high current ion beam of about 20 mA can be obtained, with a small sized configuration having a diameter of about 100 mm and a length of about 100 mm as shown in FIG. 2 and with a low electric power consumption.

Further, as seen in FIG. 4, the ion exit holes 12 are formed at positions displaced from a position E on the extension of the inner conductor of the coaxial line 2.

Next, referring to Fi9. 5, a second embodiment of the present invention will be described hereunder. The ion source of this second embodiment is suitable for a case in which a uniform, large-area, and high current ion beam is to be extracted for a long time.

A microwave 21 is divided through a coaxial branching line 3 into a plurality of lines of, for example, nine lines, of microwaves which are led into a plasma chamber 7 through coaxial cables 4 respectively. The plasma chamber 7 is formed to be a single chamber. A permanent magnet 9 which is a cylindrical one similarly to that of the first embodiment is disposed on each of the nine microwave lead-in portions in a manner so that the corresponding one of the coaxial cables 4 is passed through the inside of the permanent magnet 9. All the nine permanent magnets 9 are arranged so as to have the same polarity.

Figure 6:
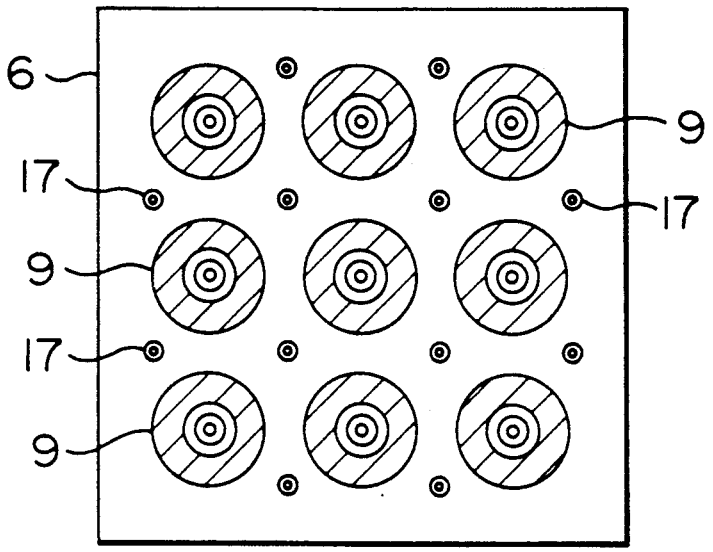
FIG. 6 is a section viewed in the direction VI—VI in FIG. 5.

FIG. 6 shows the relationship between the microwave lead-in positions and the plasma chamber 7. In order to produce plasma at a large area uniformly, the microwave lead-in positions as well as the sample-gas lead-in pipes 17 are arranged symmetrically.

Figure 7:
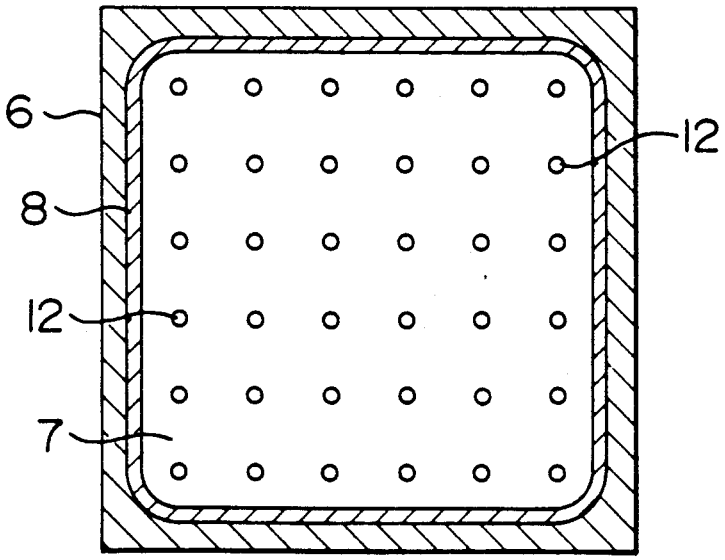
FIG. 7 is a section viewed in the direction VII—VII in FIG. 5.

FIG. 7 shows the relationship between the ion exit holes 12 and the plasma chamber 7. Each of the ion exit holes 12 has the same structure as that in the first embodiment. The ion exit holes 12 are arranged at regular intervals and grouped into a plurality of sets each including a plurality of, for example, four ion exit holes 12 for every microwave lead-in system. This is a measure to make the characteristics of the ion beams 23 extracted from the respective ion exit holes 12 coincide with each other so as to obtain a uniform and large-area ion beam 23. Thus, according to the second embodiment, it is possible to obtain an ion beam of about 120 mA in total which is large in area and which is uniform in characteristics.

Figure 5:
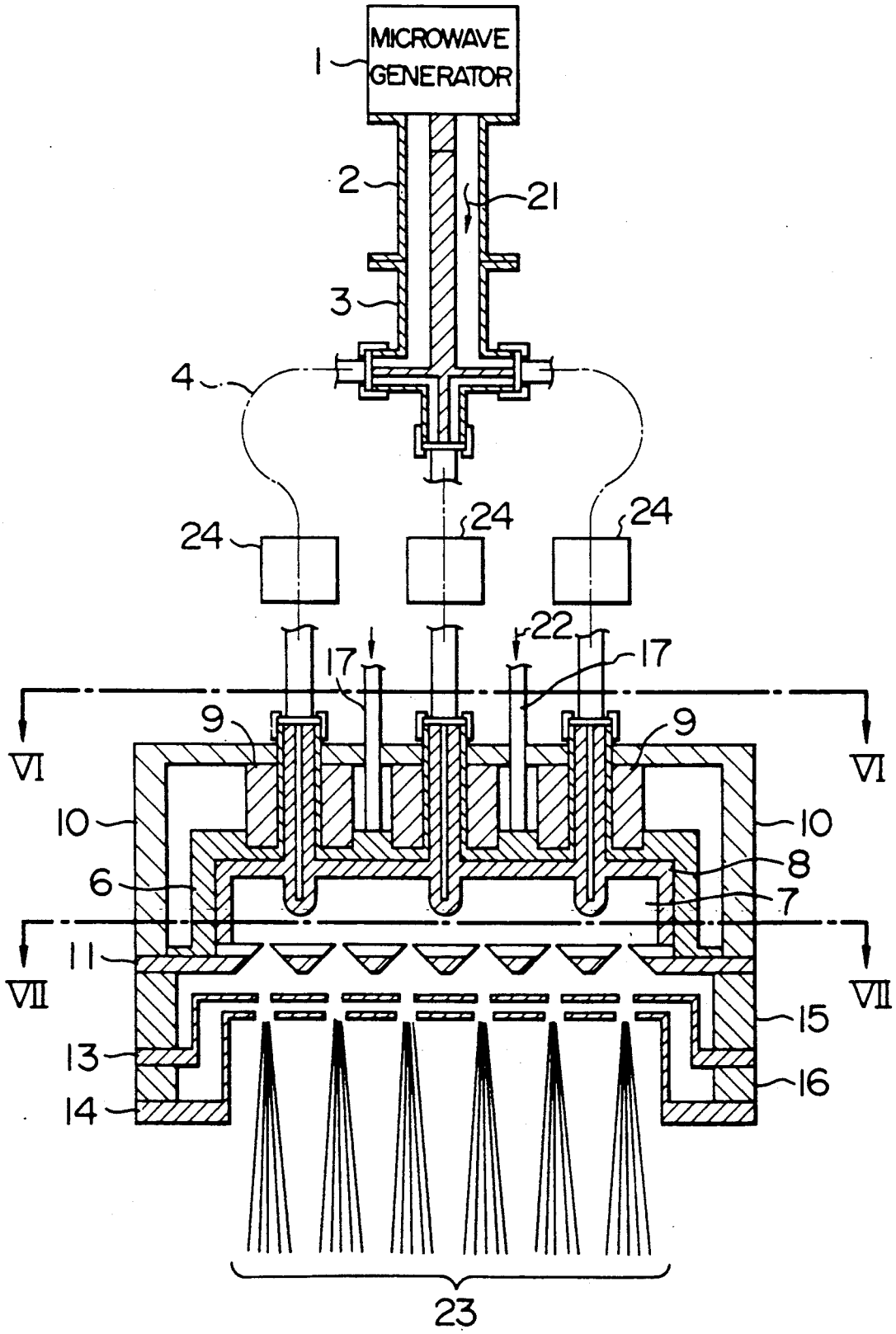
FIG. 5 is a section illustrating a second embodiment of the microwave ion source according to the present invention.

Although the permanent magnets 9 are arranged so that all the permanent magnets 9 have the same polarity in FIG. 5, the same effect as the second embodiment can be obtained even in the case where the permanent magnets 9 are arranged so that any adjacent two of those magnets 9 have different polarity so as to make the magnetic field coming out from one permanent magnet come into permanent magnets adjacent to the one permanent magnet. In this case, the magnetic path 10 shown in FIG. 5 becomes unnecessary.

Although the above second embodiment is intended to obtain a uniform and large-area ion beam, if means for controlling microwave energy to be transmitted to the branched targets, for example, attenuators 24, are additionally provided in the coaxial cable 4 in the second embodiment, it is made possible to control the distribution of density of the plasma in the plasma chamber 7 to thereby control the distribution of intensity of the large-area ion beam. Further, the same effect can be obtained even in the case where the quantities of the sample gas 22 supplied to the plasma chamber 7 through the respective gas lead-in pipes 17 are controlled independently of each other.

Figure 8:
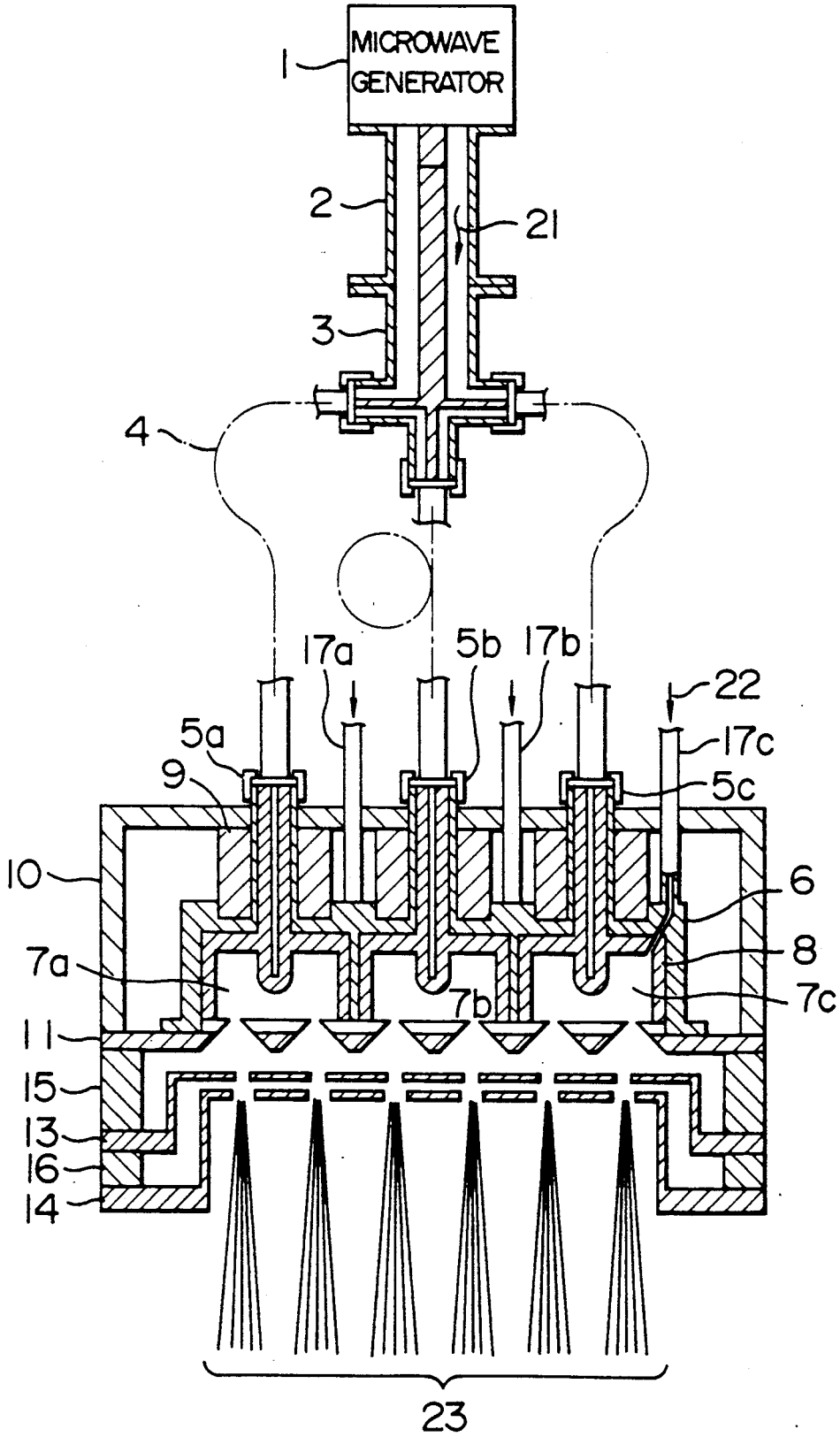
FIG. 8 is a section illustrating a third embodiment of the microwave ion source according to the present invention.

Next, referring to FIG. 8, a third embodiment of the present invention will be described hereunder. Similarly to the second embodiment, the ion source of this third embodiment is suitable for extracting a large-area and high current ion beam for a long time. This third embodiment is different from the second embodiment in the shape of the plasma chamber 7. In the third embodiment, plasma chambers 7*a*, 7*b*, 7*c*, . . . and sample gas lead-in pipes 17*a*, 17*b*, 17*c*, . . . are provided so as to respectively correspond to microwave lead-in coaxial lines 5*a*, 5*b*, 5*c*, . . . , while the plasma chamber 7 in the second embodiment is constituted by a single large chamber. The manner how to divide a microwave 21, the manner how to provide a magnetic field generating means 9, and the structure of an acceleration electrode 11 are the same as the second embodiment. According to the third embodiment, it is possible to obtain an ion beam of about 120 mA in total which is large in area and which is uniform in characteristics, similarly to the second embodiment. Further, it is possible to desirably control the existence of plasma, the kind and density of ions, etc., to be generated in the respective plasma chambers 7*a*, 7*b*, 7*c*, . . . As a result, it is possible to extract an ion beam which can be varied in characteristics in a various manner to thereby widen the field of utility of the ion source.

Thus, the present invention has remarkable effects as follows.

(1) Since the magnetic force lines coming out from the permanent magnet comes into the acceleration electrode, there exists no intense magnetic field in the space between the acceleration electrode and the deceleration electrode. Accordingly, it becomes possible to extract an ion beam with a high electric field to thereby obtain high current ion beam easily.

(2) Since the permanent magnet is arranged above the plasma chamber, it is possible to voluntarily widen a plasma chamber in a horizontal direction and to realize a large-area ion beam.

(3) Since the microwave coaxial line is entirely covered by a dielectric insulator at its portion located in the plasma chamber, the metal elements can be prevented from mixing into plasma from that portion, so that the ion source can operate for a long time.

We claim:

1. A microwave ion source comprising:

a microwave source;

a coaxial line for supplying microwaves from said microwave source into a plasma chamber;

magnetic field generating means for generating a magnetic field in said plasma chamber; and an acceleration electrode and a deceleration electrode for applying an ion extraction electric field to plasma generated by micrwave discharge in said plasma chamber;

wherein at least a part of said acceleration electrode is composed of a high magnetic permeability member so as to absorb said magnetic field;

wherein an ion exit hole is formed in said acceleration electrode; and wherein said plasma chamber is provided with a plurality of sets each including one said coaxial line, one said magnetic field generating means, and at least one said ion exit hole.

2. A microwave ion source according to claim 1, in which said magnetic field generating means is arranged around the circumference of an outer conductor of said coaxial line, and in which a first magnetic path is provided os as to connect said magnetic field generating means to said acceleration electrode so that said magnetic path and said acceleration electrode form a second magnetic path enclosing said magnetic field generating means.

3. A microwave ion source according to claim 1, in which said acceleration electrode is composed of a high magnetic permeability member and a low magnetic permeability member, said low magnetic permeability member being disposed facing ;said plasma chamber, and in which an ion exit hole is formed in said low magnetic permeability member.

4. A microwave ion source according to claim 1, in which said coaxial line in each of said plurality of sets is provided with a microwave energy control means.

5. A microwave ion source according to claim 1, comprising a plurality of sample gas lead-in systems for leading sample gases into said plasma chamber, said sample gas lead-in systems being arranged so that respective flow rates of said sample gases of said sample gas lead-in systems are controllable independently of each other.

6. A microwave ion source according to claim 3, in which a thicknesses h of said low magnetic permeability member is approximately equal to a diameter d of said ion exit hole at a side of said low magnetic permeability member facing said plasma chamber.

* * * * *